US010514211B2

(12) United States Patent
Saito et al.

(10) Patent No.: US 10,514,211 B2
(45) Date of Patent: Dec. 24, 2019

(54) VAPOR CHAMBER

(71) Applicant: FUJIKURA LTD., Tokyo (JP)

(72) Inventors: Yuji Saito, Tokyo (JP); Thanhlong Phan, Tokyo (JP); Masataka Mochizuki, Tokyo (JP)

(73) Assignee: FUJIKURA LTD., Tokyo (JP)

( * ) Notice: Subject to any disclaimer, the term of this patent is extended or adjusted under 35 U.S.C. 154(b) by 256 days.

(21) Appl. No.: 14/592,506

(22) Filed: Jan. 8, 2015

(65) Prior Publication Data

US 2015/0198375 A1 Jul. 16, 2015

(30) Foreign Application Priority Data

Jan. 10, 2014 (JP) ..... 2014-003052

(51) Int. Cl.

| | |
|---|---|
| ***F28D 15/02*** | (2006.01) |
| ***F28F 3/04*** | (2006.01) |
| ***F28D 15/04*** | (2006.01) |

(52) U.S. Cl.

CPC ..... *F28F 3/048* (2013.01); *F28D 15/02* (2013.01); *F28D 15/04* (2013.01)

(58) Field of Classification Search

CPC ..... F28F 3/048; F28D 15/0233; F28D 15/02; F28D 15/046; F28D 15/04

See application file for complete search history.

(56) References Cited

U.S. PATENT DOCUMENTS

| | | | | |
|---|---|---|---|---|
| 6,591,897 | B1 * | 7/2003 | Bhatti | H01L 23/3677 165/185 |
| 6,901,994 | B1 * | 6/2005 | Jin-Cherng | F28D 15/046 165/104.26 |
| 6,997,245 | B2 | 2/2006 | Lindemuth et al. | |
| 2006/0196640 | A1 * | 9/2006 | Siu | F28D 15/046 165/104.26 |
| 2008/0068802 | A1 * | 3/2008 | Chen | F28D 15/02 361/703 |
| 2014/0182132 | A1 * | 7/2014 | Chen | B23P 15/26 29/890.03 |

FOREIGN PATENT DOCUMENTS

| | | | |
|---|---|---|---|
| JP | 06291480 | A | 10/1994 |
| JP | 10209355 | A | 8/1998 |
| JP | 10209356 | A | 8/1998 |
| JP | 11-195738 | A | 7/1999 |
| JP | 2000-161879 | A | 6/2000 |
| JP | 2002062072 | A | 2/2002 |
| JP | 2004-238672 | A | 8/2004 |

* cited by examiner

*Primary Examiner* — Keith M Raymond
*Assistant Examiner* — Nael N Babaa
(74) *Attorney, Agent, or Firm* — Sughrue Mion, PLLC

(57) ABSTRACT

A vapor chamber having improved heat transfer capacity by efficiently returning the working fluid to the evaporating portion is provided. A hollow flat container 2 is formed by a base member 4 and a lid 3 closing an opening of the base member. Phase-changeable working fluid is held in the container, and fins 9 are arranged in the container to transmit heat of a heat generating object between the bottom plate of the base member and the lid. The fins are densely juxtaposed on an evaporating portion in comparison with the other fins juxtaposed on the outside of the evaporating portion.

6 Claims, 3 Drawing Sheets

VAPOR CHAMBER

The present invention claims the benefit of Japanese Patent Application No. 2014-003052 filed on Jan. 10, 2014 with the Japanese Patent Office, the disclosure of which is incorporated herein by reference in its entirety.

BACKGROUND

Field of the Invention

The present invention relates to an art of a vapor chamber that diffuses heat conducted to one of an upper plate or a bottom plate of a hollow flat container to the other plate in the form of a latent heat of a fluid encapsulated in the container.

Discussion of the Related Art

A heat pipe has been widely used in the conventional art to remove heat from a cooling object in the form of latent heat of working fluid. JP-A-11-195738 describes a flat heat pipe in which a hollow flat container is comprised of a rectangular upper plate and a cup-shaped main body. An inner surface of the container is covered entirely with a porous wick, and a condensable working fluid is encapsulated therein while evacuating non-condensable gas. According to the teachings of JP-A-11-195738, the flat heat pipe thus structured is enclosed entirely by a base of a heat sink but except for a bottom plate, and a CPU to be cooled is contacted to the bottom plate.

JP-A-2000-161879 also describes a flat heat pipe in which an inner surface of a hollow flat container is covered entirely with a wick formed of a sintered copper particle. In order to enlarge an evaporating area, a plurality of protrusions also formed of the sintered copper particle are juxtaposed on the wick. Heights of sidewalls of the container are higher than those of the protrusions, and a bottom of a heat sink is contacted to an upper plate of the container to exchange heat therebetween.

JP-A-2004-238672 also describes a flat heat pipe in which a wick made of sintered copper powder is attached individually to each inner face of an upper lid and a bottom plate of a hollow flat container, and those wicks are connected through a plurality of columns also made of sintered copper powder.

According to the teachings of JP-A-11-195738 and JP-A-2000-161879, the inner surface of the container is covered entirely with the porous wick. In turn, according to the teachings of JP-A-2004-238672, the porous wicks are formed on both upper and bottom inner surfaces of the container, and those wicks are connected by the columns. According to any of the teachings of the foregoing prior art documents, the condensed working fluid is returned to the evaporating portion by capillary pumping of the porous wick. However, a fluid flow resistance of the porous wick also covering a portion other than the evaporating portion is rather high. That is, the working fluid in the liquid phase is held at the portion other than the evaporating portion. In the heat pipes thus structured, if the working fluid is heated excessively at the evaporating portion, the working fluid may be evaporated more than necessary. Consequently, the evaporating portion would be dried-out thereby reducing a heat transfer capacity. According to the teaching of JP-A-2004-238672, heat transfer capacity may be enhanced by transportation heat not only by the working fluid but also through the columns. However, the column taught by JP-A-2004-238672 is also constructed of sintered porous material and the heat resistance among particles forming the columns is rather high. Therefore, the heat transfer capacity of the heat pipe taught by JP-A-2004-238672 may not be enhanced and dry-out of the evaporating portion may be caused.

The present invention has been conceived noting the foregoing technical problems, and it is therefore an object of the present invention is to provide a vapor chamber having improved heat transfer capacity by efficiently returning the working fluid to the evaporating portion.

SUMMARY OF THE INVENTION

The present invention relates to a vapor chamber comprised of: a hollow flat container having a base member and a lid closing an opening of the base member; a working fluid that is encapsulated in the container to transmit heat of a heat generating object, and that is evaporated by being heated and condensed by removing heat therefrom; and a plurality of fins juxtaposed on any of an inner face of a bottom plate of the base member and an inner face of the lid. A portion any of the inner face of the bottom plate of the base member and the inner face of the lid to which the heat generating object is contacted serves as an evaporating portion. Any of the bottom plate and the lid that is not brought into contact to the heat generating object serves as a heat radiating plate. The fins are densely juxtaposed on the evaporating portion in comparison with the other fins juxtaposed on the outside of the evaporating portion, and leading end portions of the fins are brought into contact with the inner face of the heat radiating plate to exchange heat therebetween.

Optionally, a sintered porous layer may be formed between the fins on any of the inner face of the bottom plate of the base member and the inner face of the lid to which the heat generating object is contacted.

Specifically, the fins are formed by skiving any of the inner face of a bottom plate of the base member and the inner face of the lid.

Thus, according to the present invention, the fins are densely juxtaposed on the evaporating portion to enhance the capillary pumping action, in comparison with the other fins juxtaposed on the outside of the evaporating portion. By contrast, the clearances between the fins juxtaposed on the outside of the evaporating portion are kept wider so that the fluid flow resistance therebetween is reduced. Therefore, the working fluid in the liquid phase around the evaporating portion is allowed to return smoothly and sufficiently to the evaporating portion though the clearance between the fins kept widely. Consequently, the evaporating portion can be prevented from being dried out so that the heat transfer capacity of the vapor chamber can be enhanced. As described, the leading end portions of the fins are brought into contact with the inner face of the heat radiating plate to exchange heat therebetween. Therefore, the heat of the heat generating object is transported to the lid not only through the working fluid but also through the fins. In addition, the fins are juxtaposed densely on the evaporating portion so that the heat of the object can be conducted to any of the plate from which the heat is radiated. Further, the fins also serve as reinforcement arrangement sustaining the lid so that strength of the container can be enhanced.

As also described, the sintered porous layer may optionally be formed between the fins on any of the inner face of the bottom plate of the base member and the inner face of the lid. In this case, the sintered porous layer is not necessarily to be formed on the evaporating portion. That is, the sintered porous layer is not formed entirely of the inner face in the container so that a paving area of the porous layer can be reduced. In this case, therefore, the working fluid in the liquid phase is maintained in the sintered porous layer thus formed around the evaporating portion so that the working fluid in the sintered porous layer can be pumped toward the evaporating portion by the enhanced capillary force of the fins juxtaposed densely on the evaporating portion. Consequently, the evaporating portion can be prevented from being dried out. Additionally, the fins are formed by skiving any of the inner face of the bottom plate of the base member and the inner face of the lid. Therefore, number of parts required to form the vapor chamber can be reduced without increasing heat resistance.

BRIEF DESCRIPTION OF THE DRAWINGS

Features, aspects, and advantages of exemplary embodiments of the present invention will become better understood with reference to the following description and accompanying drawings, which should not limit the invention in any way.

DETAILED DESCRIPTION OF THE PREFERRED EMBODIMENT(S)

Figure 1:
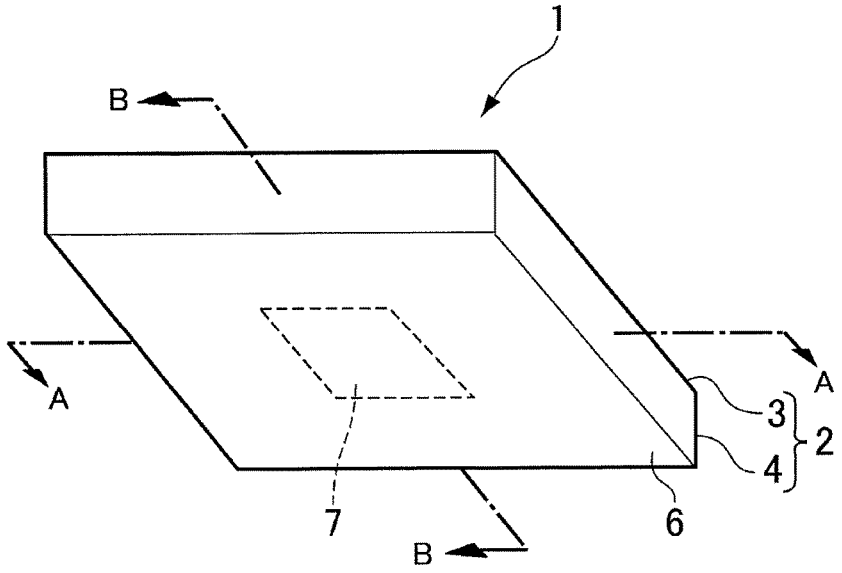
FIG. 1 is a perspective view of a vapor chamber according to preferred examples of the present invention.
Figure 2:
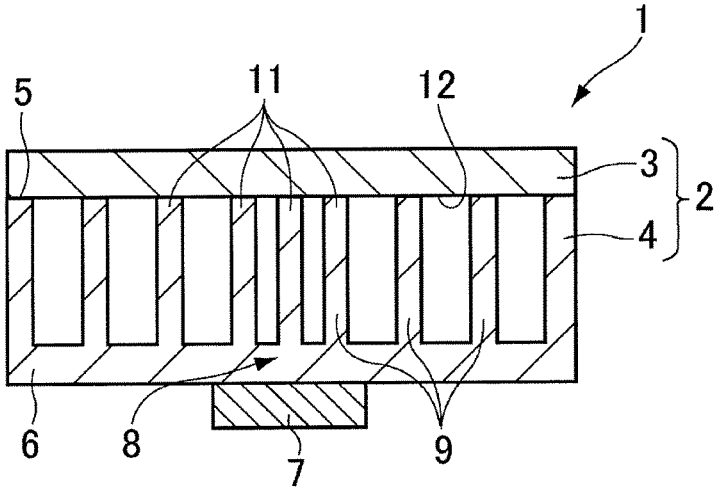
FIG. 2 is a cross-sectional view showing a cross-section of the vapor chamber according to the first example passing through an arrow A shown in FIG. 1.
Figure 3:
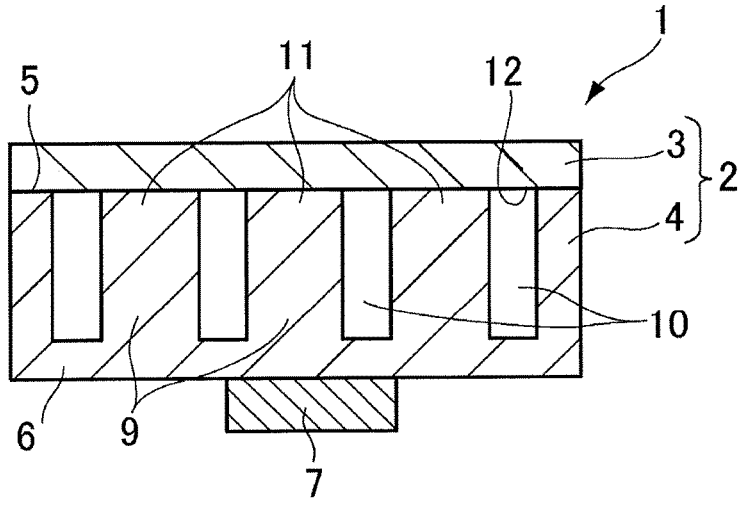
FIG. 3 is a cross-sectional view showing a cross-section of the vapor chamber according to the first example passing through an arrow B shown in FIG. 1.

Referring now to FIG. 1, there is shown a perspective view of the vapor chamber according to the present invention. As the conventional vapor chambers, the vapor chamber 1 is comprised of a hollow flat container 2, and working fluid encapsulated in the container 2 while evacuating non-condensable gas such as air. As shown in FIGS. 2 and 3, the container 2 is comprised of a lid 3 as a rectangular plate and a base member 4, and an opening 5 of the base member 4 is sealed with the lid 3. Specifically, a heat generating object 7 such as an electronic component is attached to an outer face of a bottom plate 6 of the base member 4 in a manner to exchange heat therebetween. Accordingly, a portion of an inner face of the bottom plate 6 thus contacted to the heat generating object 7 serves as an evaporating portion 8 at which evaporation of the working fluid takes place.

A plurality of fins 9 are juxtaposed on the inner face of the bottom plate 6 at regular intervals. For example, those fins 9 can be formed by the skiving method. According to the first example shown in FIGS. 2 and 3, intervals of the fins 9 juxtaposed on the evaporating portion 8 is narrower than those of the fins 9 juxtaposed on the remaining portion of the bottom plate 6. In other words, a density of the fins 9 per unit area within the evaporating portion 8 is higher than that of the fins 9 juxtaposed on the remaining portion of the bottom plate 6. That is, in the evaporating portion 8, the intervals of the fins 9 are narrowed to exert a desired capillary pressure to pump the working fluid. To this end, according to the preferred examples, the intervals between the fins 9 at the evaporating portion 8 are individually set to 0.08 mm. On the other hand, the intervals of the fins 9 in the remaining portion of the bottom plate 6 are widened to reduce fluid flow resistance. Specifically, according to the preferred examples, the intervals of the fins 9 in the remaining portion of the bottom plate 6 falls within a range from 0.1 mm to 0.3 mm. According to the preferred examples, there are three rows of fin arrays are arranged on the bottom plate 6 as illustrated in FIG. 3, and each fin array is comprised of seven fins 9 being juxtaposed to each other as illustrated in FIG. 2. Each clearance between the fin array adjacent to each other widthwise, and each clearance between an inner lateral face of the base member 4 and an outer width end of the fin array serve as air passages 10 for letting through the vaporized working fluid. The working fluid is vaporized at the evaporating portion 8 by the heat from the heat generating object 7, and the vaporized working fluid migrates toward the low-temperature and low-pressure site of the container 2 through the air passages 10 and clearances between fins 9.

As to dimensions of the fin 9, according to the preferred examples, a width is 20 mm, a height is 2.5 mm and a thickness is 0.05 mm. For example, according to the preferred examples, the container 2 in which a width is 38 mm, a height is 38 mm, and a thickness is 4 mm may be employed. Alternatively, the container 2 in which a width is 52 mm, a height is 52 mm, and a thickness is 5 mm may also be employed.

As shown in FIGS. 2 and 3, a height of each leading end 11 of the fins 9 is aligned to upper ends of side walls of the base member 4, and the opening 5 of the base member 4 is closed by the lid 3 while bringing the leading ends 11 of the fins 9 into contact with an inner surface 12 of the lid 3 to form a sealed container 2. For instance, the lid 3 can be attached to the side walls of the base member 4 and optionally to the leading ends 11 of the fins 9 by heating a solder applied therebetween in furnace a (not shown). The working fluid is selected from a group of condensable fluid including water, alcohol, ammonia, hydrochlorofluorocarbon and etc., depending on desired ranges of condensation temperature and evaporation temperature. Namely, the inner surface 12 of the lid 3 serves as a condensing portion where condensation of the vaporized working fluid takes place while radiating heat. Alternatively, the fins 9 may also be formed by skiving the inner face 12 of the lid 3. In this case, the inner face of the bottom plate 6 serves as the condensing portion.

As known in the prior art, the container 2 may be filled with the working fluid while evacuating the container 2. For example, the container 2 may be filled with the working fluid by pouring ample amount of the working fluid into the container 2, and then boiling the working fluid to evacuate the container 2.

When the heat of the heat generating object 7 is conducted to the bottom plate 6, the working fluid in the evaporating portion 8 is heated by the heat of the object 7 and evaporated. Vapor of the working fluid migrates toward the low-temperature and low-pressure site of the container 2 through the air passages 10 and clearances between fins 9, and eventually spreads all over the container 2. The ascending vapor of the working fluid is contacted to the inner surface 12 of the lid 3, and condensed again while radiating heat through the lid 3. Then, the condensed working fluid drips along the fins 9 and the inner side faces of the container 2, and puddles in the vicinity of the condensing portion 8. As described, the clearances between the fins 9 juxtaposed outside of the evaporating portion 8 are kept widened so that capillary pressure acting therebetween is weakened. That is, a fluid flow resistance in the clearance between the fins 9 thus widened is reduced, and the condensed working fluid is scarcely able to puddle therebetween. By contrast, the fins 9 are densely juxtaposed on the evaporating portion 8 to produce higher capillary pressure. Therefore, the condensed working fluid remaining around the evaporating portion 8 is pumped by the capillary action back to the evaporating portion 8 through the narrowed clearances between fins 9. In this situation, the working fluid condensed outside of the evaporating portion 8 is allowed to return sufficiently and smoothly to the evaporating portion 8 through the clearances between the fins 9 widely spaced around the evaporating portion 8. Consequently, the heat of the heat generating object 7 contacted to the evaporating portion 8 can be radiated efficiently through the working fluid without causing dry-out at the evaporating portion 8.

Thus, the heat of the heat generating object 7 is also conducted mainly to the fins 9 juxtaposed densely on the evaporating portion 8 through the bottom plate 6 while spreading all over the bottom plate 6. As described, the fins 9 are connected to the lid 3 so that the heat conducted to the fins 9 is further conducted to the lid 3 to be radiated. That is, the heat of the heat generating object 7 is transported to the lid 3 not only through the working fluid but also through the fins 9. Therefore, heat transfer capacity of the vapor chamber 1 can be enhanced.

In addition, the fins 9 also serve as reinforcement arrangement sustaining the lid 3 to enhance strength of the container 2. Therefore, deformation of the container 2 resulting from a change in the internal pressure derived from a phase change of the working fluid can be prevented. The container 2 may also be prevented from being deformed by an external force.

Figure 4:
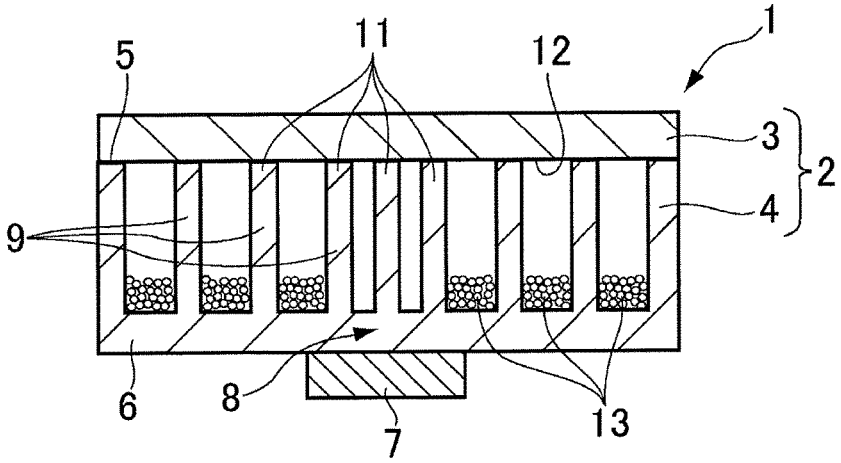
FIG. 4 is a cross-sectional view showing a cross-section of the vapor chamber according to the second example passing through an arrow A shown in FIG. 1.
Figure 5:
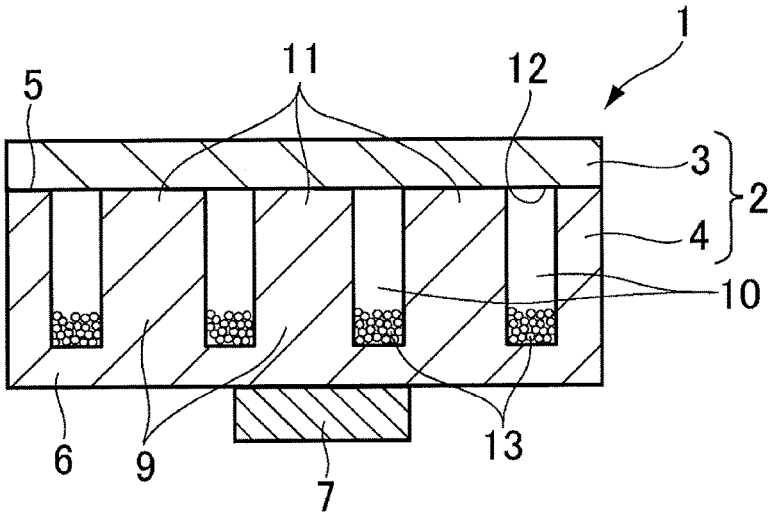
FIG. 5 is a cross-sectional view showing a cross-section of the vapor chamber according to the second example passing through an arrow B shown in FIG. 1.

Here will be explained the second example of the present invention with reference to FIGS. 4 and 5. In order to enhance the capillary action for pumping the working fluid back to the evaporating portion 8, according to the second example, a sintered porous layer 13 is formed on an inner face of the bottom plate 6 except for the evaporating portion 8 attached to the heat generating object 7. That is, the sintered porous layer 13 is formed on the inner face of the bottom plate 6 outside of the evaporating portion 8 where the density of the fins 9 is low. For example, the sintered porous body 13 is formed by sintering copper particles whose average particle size is 100 μm. According to the second example, therefore, the working fluid can be pumped to be returned to the evaporating portion 8 not only by the capillary action of the fins 9 juxtaposed densely on the evaporating portion 8 but also by the capillary action of the sintered porous layer 13. The porous sintered layer 13 exerts strong capillary force so that the condensed working fluid can be held therein. Thus, the porous sintered layer 13 also serves as a reservoir.

Specifically, the porous sintered layer 13 is formed on the bottom plate 6 by the following procedures. First of all, a predetermined amount of copper particle is spread on the inner surface of the bottom plate 6 of the base member 4 on which the fins 9 are juxtaposed. As described, the fins 9 are juxtaposed at 0.08 mm intervals on the evaporating portion 8, and at 0.1 mm to 0.3 mm intervals on the remaining portion. Therefore, the copper particles are allowed to be heaped in the clearances between the fins 9. Then, the base member 4 is sent to a furnace (not shown) to be heated thereby sintering the copper particles while fixing to the inner surface of the bottom plate 6 and bases of the fins 9. Alternatively, the porous sintered layer 13 may also be formed on the bottom plate 6 except for the evaporating portion 8. In this case, it is not necessary to feed the copper particles into the clearances between the fins 9 juxtaposed densely on the evaporating portion 8. In this case, for example, the clearances between the fins 9 juxtaposed densely on the evaporating portion 8 and optionally the air passages 10 on both sides thereof are covered from above by an extra plate. On this occasion, the clearances between the fins 9 and the air passages 10 on both sides thereof may be covered not only by a unified plate but also by separate plates. Then, the copper particles are spread all over the remaining portion of the inner face of the bottom plate 6, and thereafter heated in the furnace. Consequently, the sintered porous layer 13 is formed on the inner surface of the bottom plate 6 only around the evaporating portion 8.

Here will be explained actions of the vapor chamber according to the second example. In the vapor chamber 1 to be explained, the sintered porous layer 13 is formed only outside of the evaporating portion 8. Under the condition where the evaporating portion 8 of the vapor chamber 1 is not heated, the working fluid stays in the liquid phase and penetrates into the clearance between the fins 9 on the evaporating portion 8 and the sintered porous layer 13. When the heat of the heat generating object 7 is conducted to the bottom plate 6, the working fluid in the evaporating portion 8 and the sintered porous layer 13 is heated by the heat of the object 7 and evaporated. Vapor of the working fluid migrates toward the low-temperature and low-pressure site of the container 2 through the air passages 10 and clearances between fins 9, and eventually spreads all over the container 2. The ascending vapor of the working fluid is contacted to the inner surface 12 of the lid 3, and condensed again while radiating heat through the lid 3. Then, the condensed working fluid drips along the fins 9 and the inner side faces of the container 2, and penetrates into the sintered porous layer 13.

As a result of evaporating the working fluid, a level of menisci of the fins 9 and the sintered porous layer 13 are depressed. Consequently, the working fluid existing in the sintered porous layer 13 is pumped by the capillary action back to the evaporating portion 8. Thus, according to the example shown in FIGS. 4 and 5, the working fluid is pumped to be returned to the evaporating portion 8 not only by the capillary action of the fins 9 juxtaposed densely on the evaporating portion 8 but also by the capillary action of the sintered porous layer 13. Namely, possible capillary pressure to be exerted by the second example is enhanced by the sintered porous layer 13 in comparison with that of the first example so that the working fluid can be returned to the evaporating portion 8 more efficiently. In addition, since the sintered porous layer 13 is formed only outside of the evaporating portion 8, the working fluid will not be absorbed excessively by sintered porous layer 13 so that the working fluid the can be ensured sufficiently within the evaporating portion 8.

As the first example shown in FIG. 1, the heat of the heat generating object 7 is also conducted to the lid 3 through the fins 9. Thus, the heat of the heat generating object 7 is transported to the lid 3 not only through the working fluid but also through the fins 9. Therefore, heat transfer capacity of the vapor chamber 1 can be further enhanced.

It is understood that the invention is not limited by the exact construction of the foregoing examples, but that various modifications may be made without departing from the scope of the inventions.

What is claimed is:

1. A vapor chamber, comprising:

a hollow flat container having a base member and a lid closing an opening of the base member;

a working fluid that is encapsulated in the container to transmit heat of a heat generating object, and that is evaporated by being heated and condensed by removing heat therefrom;

a plurality of fins juxtaposed on any one of an inner face of a bottom plate of the base member and an inner face of the lid; and a sintered porous layer formed between the plurality of fins on any one of the inner face of the bottom plate of the base member and the inner face of the lid to which the heat generating object is contacted;

wherein a portion of any one of the inner face of the bottom plate of the base member and the inner face of the lid to which the heat generating object is contacted serves as an evaporating portion;

wherein any one of the bottom plate and the lid that is not brought into contact to the heat generating object serves as a heat radiating plate;

wherein the plurality of fins include first fins juxtaposed within the evaporating portion and second fins juxtaposed around the evaporating portion, wherein a density per unit area of the first fins juxtaposed within the evaporating portion is higher than a density per unit area of the second fins juxtaposed around the evaporating portion;

wherein leading end portions of the first fins juxtaposed within the evaporating portion and the second fins juxtaposed around the evaporating portion are brought into contact with the inner face of the heat radiating plate to exchange heat therebetween;

wherein the sintered porous layer is formed between the second fins juxtaposed around the evaporating portion, and wherein the sintered porous layer is only formed between the second fins juxtaposed around the evaporating portion.

2. The vapor chamber as claimed in claim 1, wherein the plurality of fins are formed by skiving any of the inner face of the bottom plate of the base member and the inner face of the lid.

3. The vapor chamber as claimed in claim 1, wherein a space is disposed above the sintered porous layer between the second fins juxtaposed around the evaporating portion, in which vapor of the working fluid migrates.

4. The vapor chamber as claimed in claim 1, wherein intervals between the second fins juxtaposed around the evaporating portion are within a range of 0.1 mm to 0.3 mm.

5. The vapor chamber as claimed in claim 1, wherein the plurality of fins comprise three rows of fin arrays.

6. The vapor chamber as claimed in claim 5, wherein each fin array comprises seven fins.

* * * * *